United States Patent [19]

Kafri et al.

[11] Patent Number: 4,614,039

[45] Date of Patent: Sep. 30, 1986

[54] NIGHT SIGHT WITH LIGHT DIFFRACTION PATTERN

[75] Inventors: Oded Kafri, Beer-Sheva; Aminadav Livnat, Arad, both of Israel

[73] Assignee: The State of Israel, Atomic Energy Commission, Nuclear Research Center Negev, Israel

[21] Appl. No.: 686,940

[22] Filed: Dec. 27, 1984

[30] Foreign Application Priority Data

Jan. 2, 1984 [IL] Israel ..... 70597

[51] Int. Cl.[4] ..... F41G 1/32; F41G 11/00

[52] U.S. Cl. ..... 33/241; 42/100

[58] Field of Search ..... 33/241, 233, 242, 243, 33/234, 235; 350/174; 356/251; 42/15

[56] References Cited

U.S. PATENT DOCUMENTS

| | | | |
|---|---|---|---|
| 1,222,620 | 4/1917 | Gaynor et al. | 33/243 |
| 2,553,540 | 5/1951 | Beckerman | 33/243 |
| 3,439,970 | 4/1969 | Rickert | 33/233 |
| 3,744,133 | 7/1973 | Fukushima et al. | 33/234 |
| 4,215,484 | 8/1980 | Lauffenburger | 33/241 |
| 4,434,560 | 3/1984 | Comeyne | 33/241 |

FOREIGN PATENT DOCUMENTS

| | | | |
|---|---|---|---|
| 317525 | 12/1919 | Fed. Rep. of Germany | 33/241 |
| 265624 | 12/1927 | Italy | 33/242 |
| 11838 | 8/1915 | United Kingdom | 33/241 |
| 125052 | 12/1918 | United Kingdom | 33/241 |

OTHER PUBLICATIONS

"Night Sight Based on Light Diffraction"-vol. 23, No. 19, *Applied Optics*-10/1/1984.

*Primary Examiner*—Willis Little

*Attorney, Agent, or Firm*—Steinberg & Raskin

[57] ABSTRACT

A night sight assembly includes a backsight and a foresight. The foresight has a glowing portion, while the backsight is in the form of a diffraction grating.

9 Claims, 4 Drawing Figures

NIGHT SIGHT WITH LIGHT DIFFRACTION PATTERN

BACKGROUND OF THE INVENTION

The present invention concerns night sights.

Sights have very widespread applications such as for aiming rifles and shotguns, telescopes and various surveying instruments and the like. Existing sights can be divided into two classes: telescopic sights which are practically small telescopes marked with a cross or a dot at the center of their field of view, and peep-hole sights, where one has to align a foresight and the target through a peep-hole. Telescopic sights have the advantage of magnifying the target without reducing its brightness. However, these sights are fragile and they have a narrow field of view which makes them impractical for heavy duty conditions. Therefore the most popular sights for heavy duty conditions, e.g. fire arms, is the peep-hole sight which is more useful because no fragile optics are required and the field of view is unlimited.

The accuracy of the peep-hole sight is simply:

$$\theta = r/l \qquad (1)$$

where r is the radius of the peep-hole and l is the distance between the foresight and the peep-hole.

A telescopic sight can be adapted for use at night by providing for illumination of the center of the field of view. However, the same reasons for which a telescopic sight is not practical for heavy duty conditions at daytime it is also impractical at night.

Peep-hole sights can also be adapted for use at night by placing a point-like light source, e.g. a $\beta$-light, at the center of the foresight. However, usually the peep-hole sight fails to work under conditions of bad illumination because the hole reduces the amount of light reaching the eye by the ratio $(r/r_i)^2$, where $r_i$ is the radius of the pupil of the eye. The pupil of the eye adjusts its aperture according to the conditions of the illumination. In order to have good visibility at night the pupil of the eye widens and the ratio $(r/r_i)^2$ decreases. A possible way to overcome this problem would be to replace the hole by a diaphragm iris of variable aperture. However, such devices often produce a non-circular aperture and besides, they are rather sensitive to humidity or dust. Moreover, high technical skills are required for adjusting the aperture of the sight to that of the eye.

SUMMARY OF THE INVENTION

It is the object of the present invention to provide a new sight suitable for night sighting and free of the above disadvantages.

In accordance with the invention there is provided a night sight assembly comprising a backsight and a foresight with a glowing portion, characterized in that said backsight is in the form of a diffraction grating.

The diffraction grating may, for example, be in the form of concentric rings, such as circular, or polygonal, e.g. quadrangular.

Other types of diffraction patterns may also be employed, such as a mosaic of different patterns. The exact form of the backsight grating will affect the virtual image around the foresight as will be explained below.

The sight assembly according to the invention may be mounted directly on the device with which it is to be associated, such as a rifle, telescope, surveying instrument or the like. Alternatively, the assembly may be in the form of an integral unit in which the backsight and foresight are mounted on a base member.

A transmission grating of the kind employed in accordance with the invention admits about 50% of the available light which is a significant improvement over a peep-hole sight.

The diffraction grating on the backsight fulfills the function of a peep-hole. As distinct, however, from conventional peep-hole sights in accordance with the invention, the effective peep-hole is self-adjusting as determined by the pupil of the eye which in turn depends on the available light.

In use the sight according to the invention utilizes a diffraction effect which makes it insensitive to the distance between the eye and the backsight.

The invention also provides devices and instruments fitted with a sight assembly as specified.

BRIEF DESCRIPTION OF THE DRAWING

The invention is illustrated, by way of example only, in the accompanying drawings in which.

DESCRIPTION OF THE PREFERRED EMBODIMENTS

Figure 1:
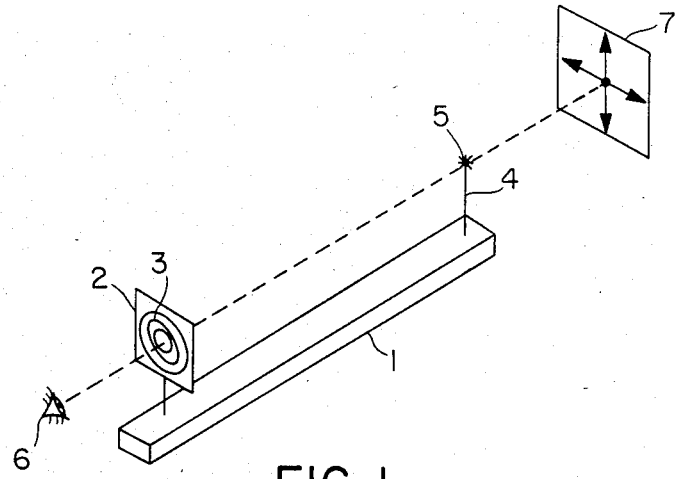
FIG. 1 is a diagrammatic illustration of a sight according to the invention in actual use.

The sight assembly according to the invention shown in FIG. 1 is an integral unit comprising a base member 1, a backsight 2 comprising a diffraction grating 3 consisting of alternating transparent and opaque concentric circular rings and having a central transparent portion, and a foresight 4 carrying on its top a point-like light source 5, e.g. a $\beta$-light.

FIG. 1 further shows the observer's eye 6 and a target 7.

It should be noted here that the light source 5 serves only for the sight proper and does not illuminate the target. It should further be noted that target 7 is shown in FIG. 1 in an unrealistic proximity to the foresight 4 and that in reality that distance is of course very much greater.

The light source 5 produces with the grating 3 a virtual diffraction pattern which, as will be explained further below, lies in a plane which also includes the central axis of foresight 4 and which is parallel to diffraction grating 3. In case of correct aiming the observer's eye 6, the backsight 2, the foresight 4 and the target 7 are all aligned. In this case a "regular" diffraction pattern is produced of the kind shown diagrammatically in FIG. 2. As seen the diffraction pattern consists of concentric circles with the light source 5 as center.

Figure 2:
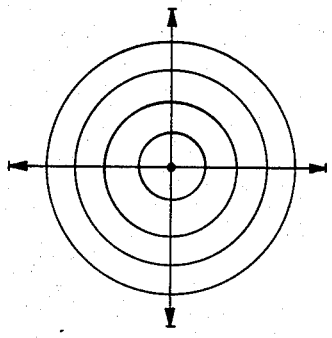
FIG. 2 shows diffraction pattern for correct aiming.
Figure 3:
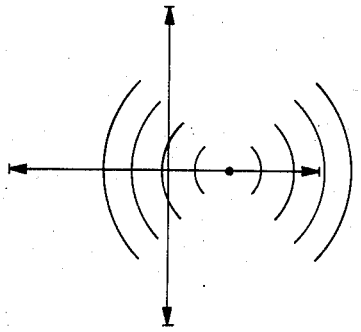
FIG. 3 shows a diffraction pattern for incorrect aiming.

If on the other hand the observer's eye 6, the backsight 2, the foresight 4 and target 7 are not aligned the diffraction pattern is distorted into a butterfly shape as shown in FIG. 3. The crosses in FIGS. 2 and 3 represent the target.

In order to bring about alignment from a non-aligned position the barrel of the instrument, e.g. a rifle, is shifted while keeping the light source on the target, until a "regular", i.e. full circular diffraction pattern is attained.

Figure 4:
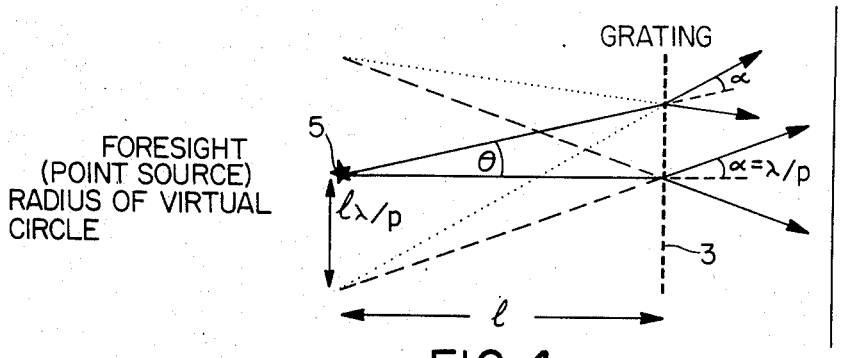
FIG. 4 is a diagrammatic illustration of the functioning of a sight according to the invention.

As mentioned, the virtual image of the diffraction pattern is located in a plane which also includes the foresight 4. This will now be explained with reference to FIG. 4. As can be seen from that Figure, rays emanating at an angle $\theta$ from light source 5, after being diffracted by the grating to several orders (the diffraction angle being $n\lambda/p$ where n is an integer and may also be zero, $\lambda$ is the wavelength and p is the grating's pitch) virtually meet on circles at a distance l in front of the gratings, the radius of each such circle being $l\lambda/p$.

The advantages attained with a sight according to the invention may be summed up briefly as follows:

1. it can be used both at day and night time;
   b. it obstructs a relatively small portion of the available light;
3. it is insensitive to the distance between the eye and the grating which may be useful for pistols and other optical devices;
4. the effective peep-hole is self-adjusting and is determined by the pupil of the eye;
5. because of the fact that the virtual diffraction pattern is in the plane of the foresight the eye must be focused on two distant objects only, the foresight and the target aimed at.

We claim:

1. In a sighting assembly adapted for use by an observer including a support, a backsight mounted on said support adapted to be situated close to an eye of the observer during use, and a foresight mounted on said support in alignment with said backsight, said foresight having light-emitting means, the improvement comprising, said backsight comprises a diffraction grating.

2. The combination of claim 1 wherein said sighting assembly is adapted for use in sighting a target and wherein said diffraction grating comprises means for producing a regular virtual diffraction pattern in a plane substantially parallel to said diffraction grating and substantially containing said foresight when said backsight, foresight and target are in alignment.

3. The combination of claim 1 wherein said support comprises a weapon.

4. The combination of claim 1 wherein said support comprises an optical instrument.

5. The combination of claim 1, wherein said support comprises a base member adapted to be mounted on a device.

6. In an assembly adapted for use by an observer including a device, a backsight mounted on said device adapted to be situated close to an eye of the observer during use, and a foresight mounted on said device in alignment with said backsight, said foresight having light-emitting means, the improvement comprising, said backsight comprises a diffraction grating.

7. The combination of claim 6 wherein said assembly is adapted for use in sighting a target and wherein said diffraction grating comprises means for producing a regular virtual diffraction pattern in a plane substantially parallel to said diffraction grating and substantially containing said foresight when said backsight, foresight and target are in alignment.

8. In an assembly adapted for use by an observer including a device, a base member mounted on said device, a backsight mounted on said base member adapted to be situated close to an eye of the observer during use, and a foresight mounted on said base member in alignment with said backsight, said foresight having light-emitting means, the improvement comprising, said backsight comprising a diffraction grating.

9. The combination of claim 8 wherein said assembly is adapted for use in sighting a target and wherein said diffraction grating comprises means for producing a regular virtual diffraction pattern in a plane substantially parallel to said diffraction grating and substantially containing said foresight when said backsight, foresight and target are in alignment.

* * * * *